US006578757B1

(12) United States Patent
Espenshied et al.

(10) Patent No.: US 6,578,757 B1
(45) Date of Patent: Jun. 17, 2003

(54) PHOTO MAILER

(76) Inventors: John R. Espenshied, 453 - 10th St., Santa Monica, CA (US) 90402; Jeffrey S. Marks, 453 - 10th St., Santa Monica, CA (US) 90402

( * ) Notice: Subject to any disclaimer, the term of this patent is extended or adjusted under 35 U.S.C. 154(b) by 0 days.

(21) Appl. No.: 10/046,879

(22) Filed: Jan. 14, 2002

Related U.S. Application Data

(60) Provisional application No. 60/290,110, filed on May 11, 2001.

(51) Int. Cl.[7] ..... B42D 15/00
(52) U.S. Cl. ..... 229/92.8; 40/754; 40/774
(58) Field of Search ..... 229/71, 92.8, 92.3; 40/774, 775, 754

(56) References Cited

U.S. PATENT DOCUMENTS 1,347,269 A * 7/1920 Greble ..... 40/750
1,421,097 A * 6/1922 Pente ..... 40/754
3,174,244 A * 3/1965 Walton ..... 40/774
4,780,975 A * 11/1988 Friedman ..... 40/755
5,133,496 A * 7/1992 Davidson et al. ..... 229/92.8
5,337,949 A * 8/1994 Seeley ..... 229/92.8
5,678,756 A * 10/1997 Sugiura ..... 229/313

FOREIGN PATENT DOCUMENTS

GB 12272 * 6/1904 ..... 229/92.8

* cited by examiner

*Primary Examiner*—Jes F. Pascua
(74) *Attorney, Agent, or Firm*—Roger A. Marrs

(57) ABSTRACT

A photo mailer and frame combination having a single blank or sheet with fold or score lines permitting portions of the blank or sheet to be folded over and secured to provide a photo enclosing pocket to be used as a postal mailer and a cover portion carrying indicia for inside message information and outside mailing information. The cover and pocket portions being adapted to convert the mailer upon receipt by the addressee into a frame for display of the photo. A display window is provided for photo viewing when converted to a frame and support structure is included for supporting the mailer when converted into a photo frame or holder.

3 Claims, 4 Drawing Sheets

10
11
12
13
14
15
16
17
18
20
21
22
23
24
25
26
27
28
29
30
31
32
33
34
35
36
3

44
47
70
45'
13
50
45
42
54
57
56
72
43
55
53
51
41
42'
43'
46
40
52
7
8
44'
59

PHOTO MAILER

This application claims the benefit of Provisional application Ser. No. 60/290,110, filed May 11, 2001.

BACKGROUND OF THE INVENTION

1. Field of the Invention

The present invention relates to the field of mailing envelopes and pouches, and more particularly to a novel mailer which includes a unitary constructed envelope comprising a sheet having an inside message portion which when folded over upon itself defines a pocket or envelope into which photos, cards, or the like may be deposited for mailing. The mailer includes a mounting portion for supporting a photo for display purposes when received by the addressee.

2. Brief Description of the Prior Art

In the past, it has been the conventional practice to mail photos, cards or the like in envelopes which are merely a sheet folded over upon itself to define a pocket into which the photo, card or the like is releasably supported. The sheet further includes a closing flap which folds over the entrance to the envelope and seals so that the contents of the pocket will not be dislodged or fall from the envelope. In some instances, padding such as plastic bubbles or the like are placed inside the envelope for protection of photos during transit.

Although conventional envelopes do include an area on the front space of the envelope to which addressee and addressor information is placed, there is usually not a message area inside the envelope for carrying a short salutation, greeting or message. Also, the conventional envelope is not used for mounting of photos after it has been received by the addressee as the conventional envelope is usually discarded. Still other problems are encountered which stem from the fact that the paper stock used for envelopes is very thin and light so that rips and tears are easily encountered as the envelope passes through normal mail handling procedures.

Therefore, a long-standing need has existed to provide a mailing envelope or mailer for photos or the like that is reinforced so as to prevent tearing, rips or damage during mailing processing, and which can further be employed as a frame or mounting for photographs after the mailing procedure has been completed. Also, provision should be made for carrying a brief message on the inside of the envelope as well as protecting a photo or the like during transit.

SUMMARY OF THE INVENTION

Accordingly, the above problems and difficulties are avoided by the present invention which provides a novel photo mailer which includes an elongated sheet or blank which has three score lines placed in fixed, spaced-apart relationship across the width of the sheet and which are adapted to be folded over by portions of the sheet so as to provide a pocket and a message area and a closure flap. Reinforcing thicknesses may be placed along the edge marginal regions of the sheet to provide stiffness and stability which prevents rips, tears, or the like from occurring during the mailing procedure. The portion of the sheet defining the envelope or pocket is provided with score lines so that upon receipt of the mailer, the addressee may separate a portion of the pocket whereby the separated portion serves as a mounting for a photo. To support the photo, the separated portion is provided with angular cuts so as to insertably receive corners of the photo for mounting. In another version, the sheet may be merely reverse folded by the addressee so that the photo mounting portion is supported by the message portion of the mailer while fully displaying the photo from the surface thereof.

In another version, the blank or sheet includes two spaced-apart horizontal fold lines with a third fold line normal to the horizontal lines which joins with an extension flap foldable over and edge secured to provide a photo pocket. The flap includes a viewing window for an enclosed photo or the flap may include slits for insertably receiving corners of the photo. A closure flap or portion includes a tab or adhesive means for retaining the mailer in its mailing condition.

Therefore, it is among the primary objects of the present invention to provide a novel photo mailer which not only includes a protective pocket for the photo, but includes an internal message carrying area for greetings, salutations or other indicia.

Another object of the present invention is to provide a novel mailer having an internal message portion, a pocket portion for a photograph, and wherein the pocket portion can be used as a display stand for the photo by the addressee at completion of the mailing and delivery process.

Another object of the present invention resides in providing a mailing envelope or mailer for a photograph having reinforced edge marginal regions to prevent damage to the envelope and which further includes mounting means for the photo after received by the addressee.

A further object resides in providing a photo mailer enclosing a photo during the mailing process and which permits portions of the mailer to be reverse folded to provide a frame for photo storage and display.

Still a further object resides in a novel photo mailer formed from a single blank or sheet which provides a photo enclosure pocket, a release closure for securement in a mailing position and support means providing a display frame or holder for the photo when received by the addressee.

Another object resides in a combined photo mailer and display frame combination having a scored blank or sheet adapted to be folded over upon itself to provide either a mailer with a portion of the blank or sheet protecting the photo or a frame with the portion of the blank or sheet supporting the photo for visual display.

The combined photo mailer and display frame incorporates a single blank of foldable material separable into various portions that folded over define either a postal mailer or a display frame.

The combined photo mailer and display frame may exhibit the photo upon receipt by the addressee in a hanging position, an angular position or in a vertical or horizontal position.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figures 1, 2, 3, 4, 5:
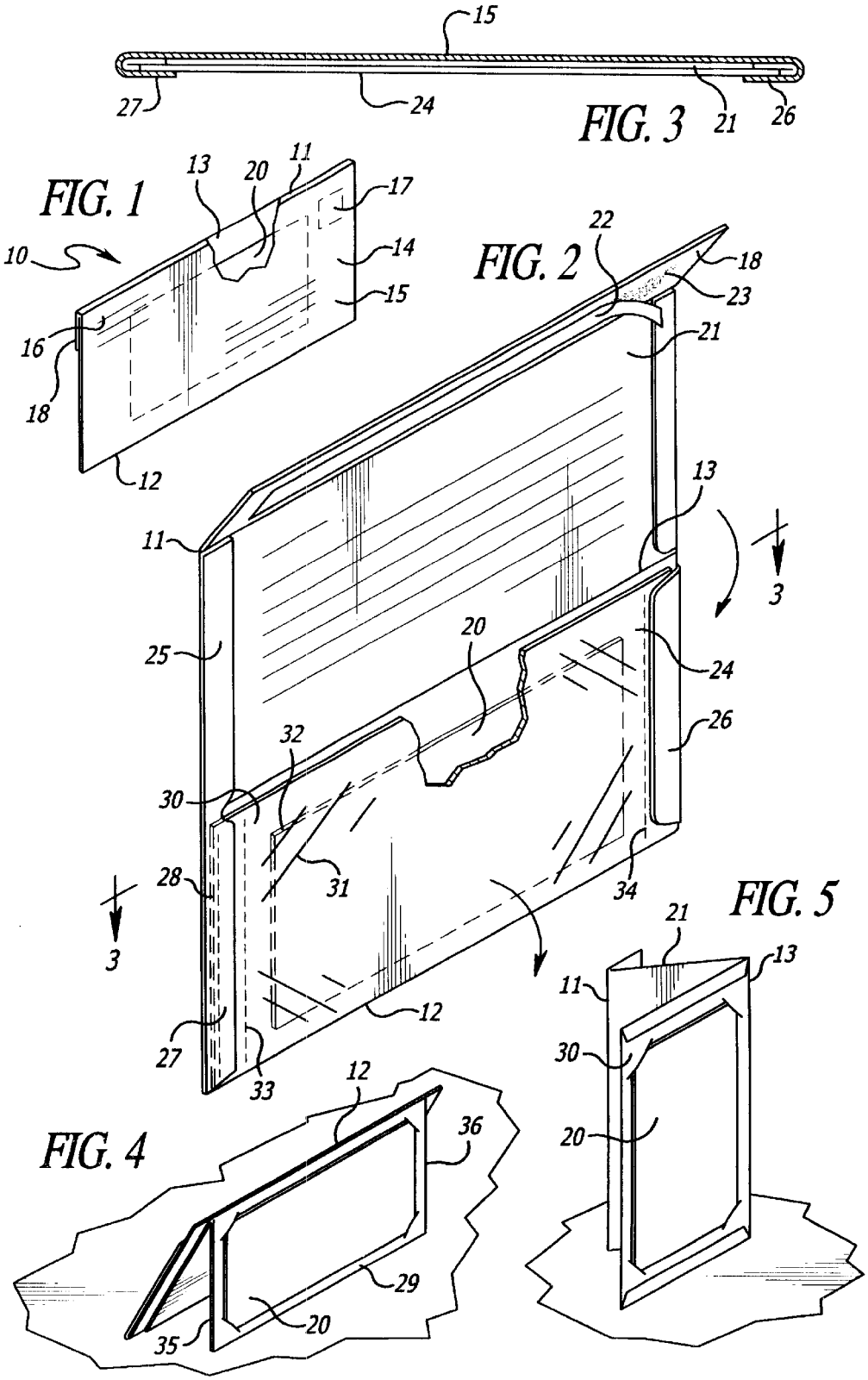
FIG. 1 is a reduced, front elevational view illustrating a combined photo mailer and display frame incorporating the present invention.
FIG. 2 is a perspective view of the envelope shown in FIG. 1 having a message portion displayed as well as an envelope or pocket portion of the mailer for holding a photo.
FIG. 3 is a longitudinal, cross-sectional view of the combined mailer and frame shown in FIG. 2 as taken in the direction of arrows 3—3 thereof.
FIG. 4 is a reduced perspective view illustrating the combined mailer and frame shown in FIGS. 1 and 2 employed as a mounting and display device for the photo.
FIG. 5 is a view similar to the view of FIG. 4 illustrating a different mode of photo mounting and display using the combined mailer and frame illustrated in FIGS. 1 and 2.

Referring now in detail to FIG. 1, the novel photo mailer is illustrated in the general direction of arrow 10 which includes a sheet of material having at least three fold lines as indicated by fold line 11, fold line 12, and a fold line 13. The mailer includes an exposed front surface 14 suitable for carrying addressee and addressor information. As is the usual practice, addressee information is indicated in the area illustrated by numeral 15 while addressor information is carried in an area identified by numeral 16. A suitable stamp or other postage indicator is carried in an area 17. It is noted that the mailer is closed by means of a flap 18 which is folded about fold line 11 so as to enclose a card or photo 20 within the mailer.

Referring now to FIG. 2, it can be seen that the opposite or inside surface of the mailer from surface 15 is indicated by numeral 21 and serves as a message portion on which salutations, congratulatory messages, personal message or the like can be carried. Also, it can be seen that the flap 18 includes a peel strip 22 which when removed reveals an adhesive 23 which is used to close the flap 18 when folded about fold line 11.

FIG. 2 also illustrates that a pocket or envelope portion is defined by means of a panel section 24 that is folded along fold line 12 so that its extreme end terminates adjacent fold line 13. An entrance to the pocket or envelope is open between the terminating edge of the section 24 and the fold line 13 through which the card or photo 20 may be inserted so as to be covered and protected by the pocket. Also, the lateral edge marginal regions of the unitary sheet of material forming the pocket and the message area may be reinforced by an added thickness of material as identified by strip 25 and 25'. The strips may be provided on either side of the mailer or on one side as desired. However, it is noted that lateral strips 26 and 27 not only reinforce the edge marginal regions of the pocket but serve to close the ends of the pocket when folded over the portion 24 and secured by adhesive or the like. One edge of the portion 24 is indicated by numeral 28 which resides below the strip 27. Also, it is to be noted that the surface 30 of the portion 24 includes angular slits or cutouts such as indicated by numeral 31 which are intended to be used after the mailing procedure for supporting the corners of the photo for display purposes. However, it is to be understood that during the mailing procedure, the corners of the photo 20 may be inserted through the angular slots for stability and packing of the photo. For example corner 32 of the photo is inserted under the slit or strip 31 to hold the corner of the photo. The other three corners are held in position in a similar manner. It is also to be noted that the portion 24 may include side perforations 33 and 34 that are immediately adjacent the strips 26 and 27. Once the mailer has been received by the addressee, the envelope may be opened and a segment 29 of the portion 24 may be separated from the side strips 26 and 27 by tearing down the slots or perforations 33 and 34. This segment of the panel portion may now be used to display the photo as indicated in FIG. 4.

In FIG. 4, it can be seen that when the portion 24 is folded along fold line 12 in a reverse manner, the photo 20 is exposed for display purposes as mounted. The perforations 33 and 34 have been broken so that the side edges of portion 24 are exposed and are indicated by numerals 35 and 36.

However, as illustrated in FIG. 5, the photo 20 may readily be exhibited without tearing the perforations 33 and 34 by merely folding the sheet on fold line 13 in a reverse manner.

In view of the foregoing, it can be seen that the novel mailer 10 of the present invention not only includes an internal envelope for holding the photo but that portion of the mailer serves as a mounting for displaying the photo once received by the addressee. Also, it is to be noted that the mailer is composed of a single elongated sheet or blank that has been folded along three fold lines to provide the various sections or portions and that reinforcing flaps or strips can be also incorporated into the sheet. The slots or slits for receiving the corners of the photo also lighten the overall weight of the envelope which is a distinct advantage in view of postage being calculated on the basis of weight. Preferably, the sheet for the mailer is composed of a cardboard having a thickness sufficient to resist normal tear and wear while being handled through the mailing procedure.

Figures 6, 7, 8, 11:
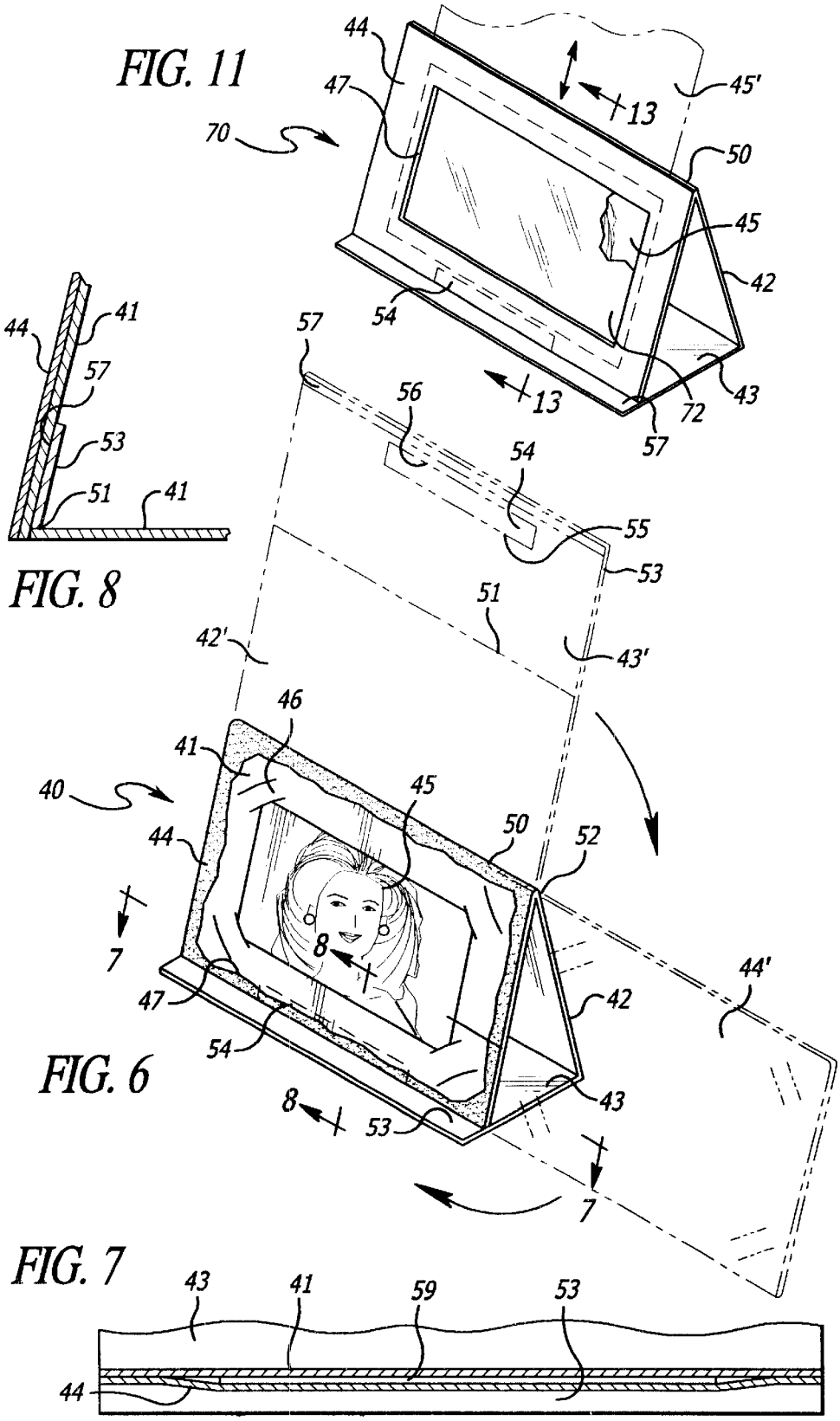
FIG. 6 is a front perspective view of another version of the present invention.
FIG. 7 is an enlarged fragmentary cross-sectional view taken in the direction of arrows 7—7 of FIG. 6.
FIG. 8 is an enlarged fragmentary cross-sectional view of the photo mailer and frame combination shown in FIG. 6 taken in the direction of arrows 8—8 thereof.
FIG. 11 is a reduced front perspective view of the photo mailer similar to the photo mailer shown in FIG. 6 which includes a transparent or translucent window covering the enclosed photo.

Referring now to FIG. 6, another embodiment of the present invention is illustrated by arrow 40 wherein the photo mailer includes a single sheet or blank of material divided into portions by score or fold lines. For example, numeral 41 indicates a back portion of the blank or sheet while numeral 42 represents a cover portion and numeral 43 indicates a closure flap. The blank or sheet prior to folding is indicated in broken lines and the broken lines portion of the blank or sheet are indicated by the numerals with prime marks. A frame portion of the blank or sheet is indicated by numeral 44. Either the back portion 41 or the frame portion 44 can carry the photo by any suitable means. For example, a photo is indicated by numeral 45 and the corners of the photo are insertably received within slots, such as slot 46, in the back portion 41. However, it is to be understood that the slots for receiving the corners of the photo may alternately be included on the frame portion 44 and such slots are indicated in broken lines on the broken line showing of the frame portion indicated by numeral 44 prime. In solid lines, the frame portion 44 includes a central opening 47 which surrounds the photo 45. The edge marginal region of the frame portion 44 may be scalloped or include other decoration or display characters at the selection of the user. If the photo 45 is mounted on the inner surface of the back portion 41, the photo is observable through the opening 47 through the edge marginal region of the frame portion 44. However, should the photo be mounted on the frame portion 44, then there is no necessity to have an edge marginal region which surrounds the photo. It is to be understood that other means for mounting the photo onto either the back portion or the frame portion can be considered such as a low contact adhesive or the like.

It can be seen further in FIG. 6 that the back portion 41 is integrally attached to the cover portion 42 by means of a fold line 50. The opposite edge of the cover portion 42 includes a fold line 51 which connects with the closure flap 43. In a similar fashion, a fold line 52 integrally connects the outside edge of the back portion 41 with the frame portion 44. Once the mailer has been received by an addressee, the blank or sheet can be folded along the respective fold lines into the configuration shown in solid lines. In this configuration, the closure flap 43 becomes a base for the frame while the cover portion 42 becomes a support for the backframe 41 carrying the photo 45. The frame portion 44 is illustrated as being folded over to either display the photo 45 carried on the frame portion or if the frame portion includes an edge marginal region defining opening 47, the photo will be displayed therethrough.

When the mailer is used as a frame holder for the photo, the edge marginal region 53 of the closure flap may include residue adhesive so that the edge marginal region 53 can be folded up and adhesively engage with the frame portion 44 along the lower or bottom edge thereof. However, another means for attaching the closure flap 43 may include a tab 54 which is outlined by a perforation 55 so that the tab 54 can be punched out from the closure flap 43 and folded along fold line 56 whereby it may be inserted into an opening between the opposing surfaces of the frame portion 44 and the back portion 41. The adhesive for the closure flap is indicated by numeral 57 if used.

Referring to FIG. 7, a gap 59 is defined between the opposing surfaces of the frame portion 44 and the back portion 41. The tab 54 is inserted into the gap or opening 59 as previously described.

Referring now to FIG. 8, the alternative method of affixing tab or edge marginal region 53 to the back portion 41 is illustrated in which the low contact adhesive 57 is used to adhere the edge marginal region 53 to the backside of the back portion 41. The means for attachment are alternative between the methods illustrated in FIGS. 7 and 8.

Figure 9:
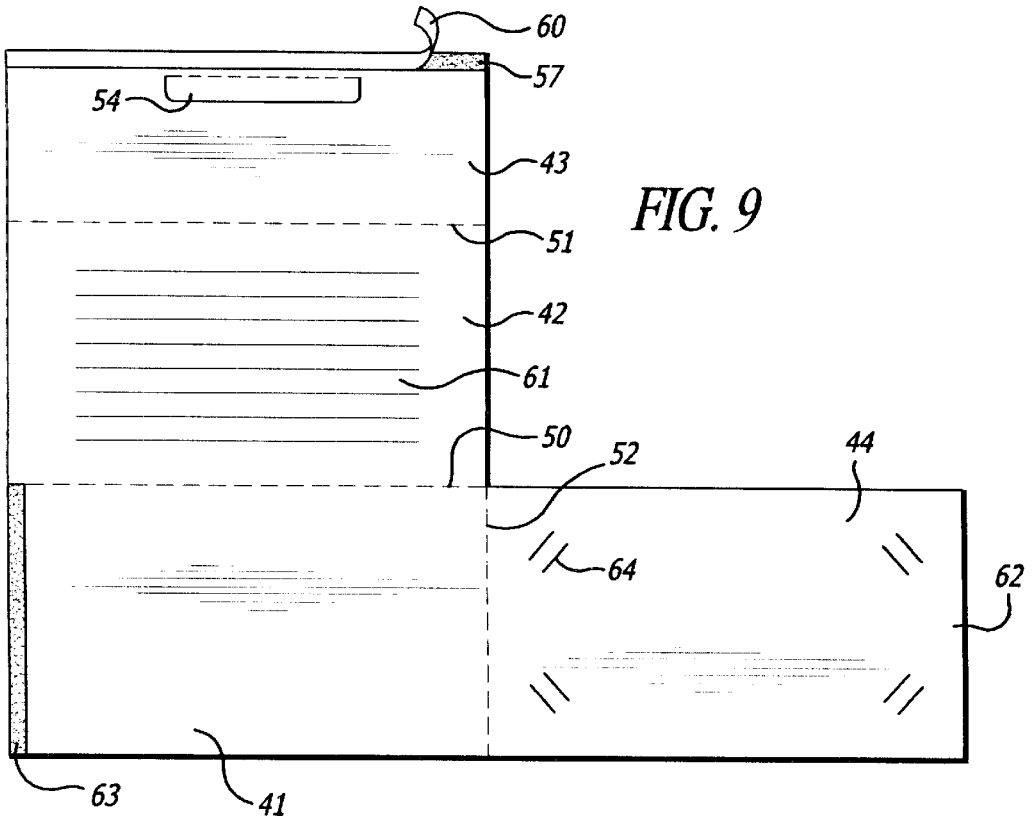
FIG. 9 is a layout illustration of a single blank or sheet from which the photo mailer is formed, illustrating the inside thereof preparatory to folding.

Referring now in detail to FIG. 9, an inside or reverse layout illustration is provided showing that the various portions of the photo mailer are integrally formed from a single blank or sheet. The adhesive 57 may be covered temporarily by a peel-off strip 60 and the inside surface of the cover portion 42 may include an area for carrying a personal message or the like and the area is indicated by numeral 61. Also, it can be seen that the frame portion 44 may be folded over by means of fold line 52 and the end edge marginal region 62 affixed to the back portion 41 by means of an adhesive 63. Therefore, a slot or gap 59, as shown in FIG. 7, may be created in which to receive insertion of the tab 54 into the slot or gap 59 as shown in FIG. 7. As illustrated in FIG. 9, the frame portion 44 includes a plurality of slots such as slot 64 which may readily insertably accept the corners of the photo 45 as previously described. It is to be understood that such slots may be placed on the portions 41, 42, and 61, as previously described and indicated by numeral 46 in FIG. 6.

Figure 10:
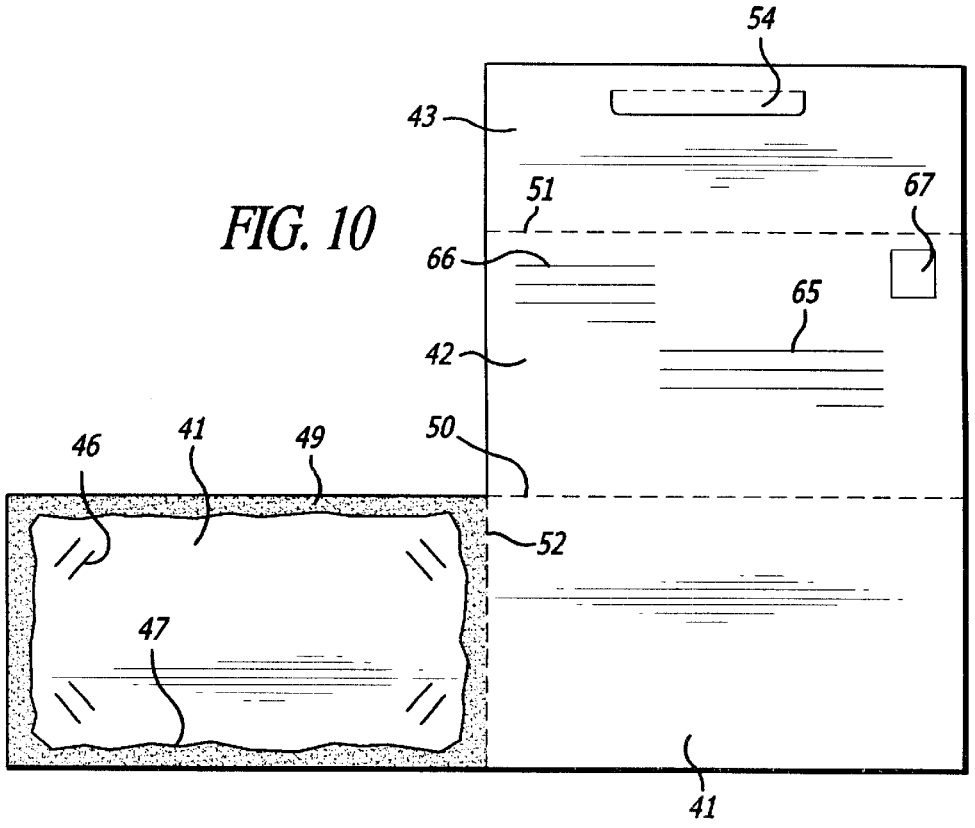
FIG. 10 is a view similar to the view of FIG. 9 illustrating the outside of the photo mailer.

Referring now in detail to FIG. 10, the outside or obverse of the mailer is illustrated in which the frame portion 44 includes an edge marginal region forming a frame margin identified by numeral 49 carried on the back portion 41. The opening 47 may be scalloped or straight edged depending on the decoration selected. The frame 44 may include any type of indicia, graphic representations or alpha/numeric data for decorative purposes. Also, the cover portion 42 may include on its outside, or external surface, information pertaining to an addressee indicated by numeral 65, an area 66 for carrying sender information and numeral 67 indicating placement of a postage stamp.

In FIG. 11, a photo mailer is illustrated as folded over by a recipient so a frame or holder is provided for visually displaying the photo 45. The frame portion 44 exposes the photo through opening 47 which may or may not have a clear window 72 attached to the inner surface of the frame portion. The closure flap 43 serves as a base with the edge marginal region carrying either the residue adhesive 57 engaged with the frame portion or alternately, the tab 54 may be inserted into the gap 59 as shown in FIG. 7. The cover portion 42 serves as a back or rear support while the opposing surfaces of the frame portion 44 and back portion 41 provide a pocket for insertably receiving the photo 45.

Figure 12:
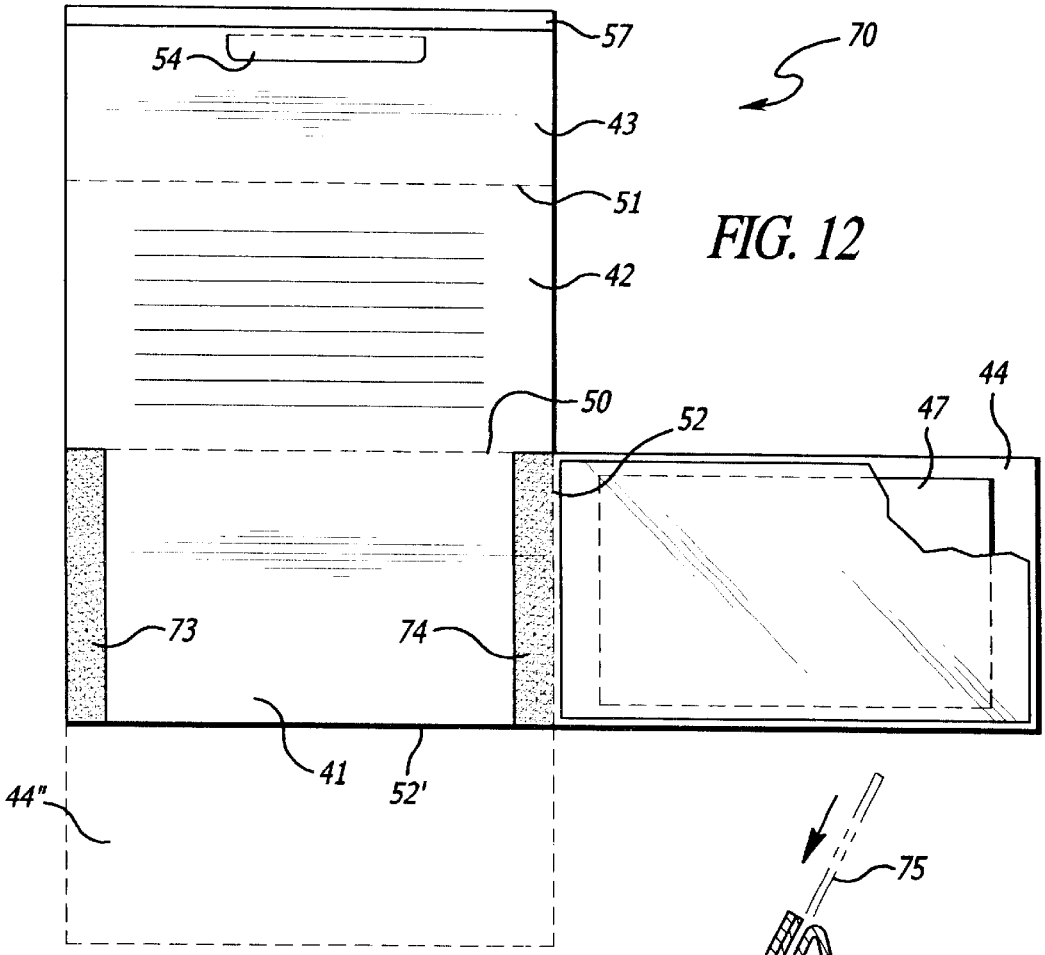
FIG. 12 is a layout view of the version of a photo mailer shown in FIG. 11 incorporating the present invention wherein the transparent or translucent sheet forms a portion of the pocket per se.
Figure 13:
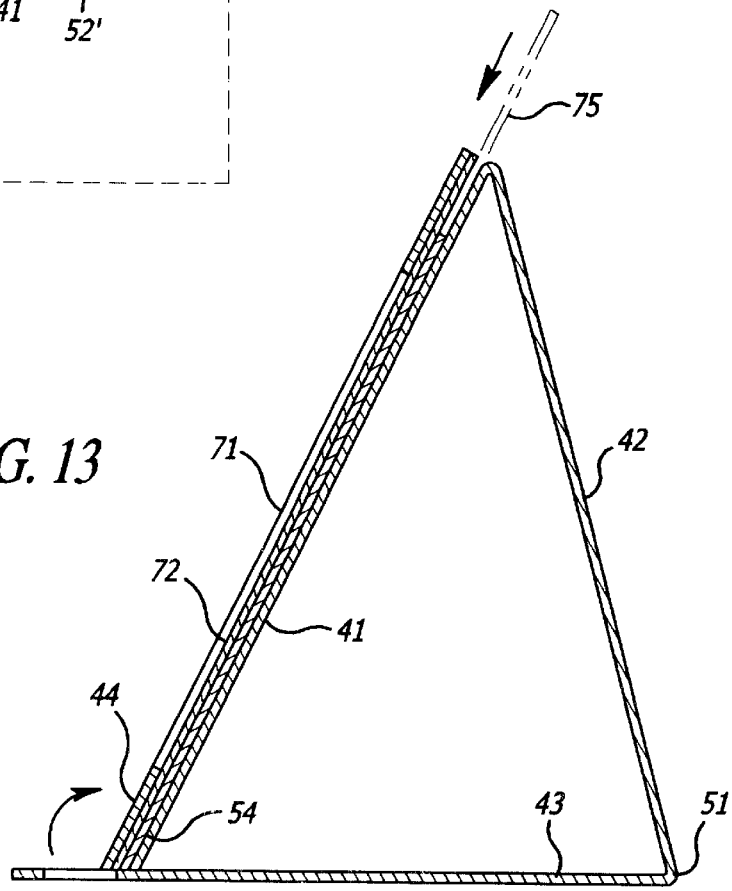
FIG. 13 is a cross-sectional view of the photo mailer shown in FIG. 11 when used as a photo display frame and holder.

Referring now in detail to FIGS. 12 and 13, the novel photo mailer incorporating the present invention is illustrated in the general direction of arrow 70. The basic blank or sheet is divided into portions as previously described. However, frame portion 44 includes a cut-out opening 47 which is covered by a transparent or translucent sheet 72. The edge marginal regions of the sheet 72 are fixly secured to the inside surface of the frame portion 44 by suitable adhesive or the like. Furthermore, when the frame portion 44 is folded along fold line 52, the peripheral edges of the inside surface of the frame portion 44 are secured to the opposite edges of the base member or back member 41. Adhesive 73 and 74 carried in strips will engage with the respective adjacent surfaces of the frame portion 44 and secure the frame portion to the back portion 41. At this time, a photo as indicated by numeral 75 in FIG. 13 can be inserted between the opposing surfaces of the frame portion 44 and the back portion 41 so that the photo will be displayed through the window 47 and the transparent panel sheet 72. The flap 54 may be inserted into a gap or opening 59 as shown in FIG. 7 or the edge marginal region of the closure flap can be adhered as previously described and shown in FIG. 8 with its residue adhesive 57.

An alternate construction is to provide a frame portion 44" as downwardly depending from the back portion 41 rather than outwardly extending in a side or lateral direction. Fold line 52' attaches frame portion 44" to the back portion 41 so that all fold lines are in parallel spaced-apart relationship. The photo can be carried on the frame portion 44" as previously described. All fold lines may be scored, reduced thickness, perforations, slots or the like.

Fold line 52' may include a slot for insertably receiving tab 54 or residue adhesive may be used to secure the flap 43 to the back portion.

In view of the foregoing, it can be seen that the photo mailer of the present invention may include a frame which includes printed decoration or may include scalloped or other shaped openings to reveal the photo behind it. The photo may be held in position by insertion into a pocket defined between the opposing surfaces of the frame portion 44 and the back portion 41 or the photo may be displayed through a transparent pane or sheet 72 which forms part of the pocket.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A photo mailer and frame combination comprising:

a foldable sheet having a mailer position and a frame position;

said foldable sheet having a cover portion separating a closure flap and a back portion;

a frame portion outwardly projecting from said back portion and adapted to be folded over said back portion and attached thereto;

a photo carried on said back portion between said frame portion and said back portion;

said frame portion having a central opening exposing said photo when said foldable sheet is in said frame position;

said cover portion covering said photo and said frame portion central opening when said foldable sheet is in said mailer position;

said closure flap includes attachment means for coupling said closure flap to said back portion so as to serves a base for supporting said sheet in said frame position;

said cover portion serves as a support for said back portion when said foldable sheet is in said frame position;

said frame portion having a decorative border about said central opening;

a translucent or transparent pane secured to said frame portion covering said central opening; and said attachment means includes residue adhesive on said closure flap after initial use to provide said mailer position.

2. A photo mailer and frame combination comprising:

an elongated sheet divided into a message section separating a pocket section from a closure flap by parallel, spaced-apart fold lines;

said pocket section having a frame portion and a back portion providing said pocket section when said frame portion is folded over said back portion;

at least one photo;

means disposed on said frame portion cooperating with said photo for detachably mounting said photo on said frame portion;

said sheet is foldably oriented to a first mailer position with said message section covering said photo and a second frame position with said message section supporting said frame portion to expose and display said photo;

closure means carried on said closure flap for releasably securing said closure flap to said back portion when said sheet is in said first mailer position;

said frame portion includes a removable panel across said pocket section enclosing said photo when said sheet is in said first mailer position; and said panel detached from said frame portion to mount and expose said photo when said sheet is in said second frame position.

3. A photo mailer and frame combination comprising:

an elongated sheet divided into a message section separating a pocket section from a closure flap by parallel, spaced-apart fold lines;

said pocket section having a frame portion and a back portion providing said pocket section when said frame portion is folded over said back portion;

at least one photo;

means disposed on said frame portion cooperating with said photo for detachably mounting said photo on said frame portion;

said sheet is foldably oriented to a first mailer position with said message section covering said photo and a second frame position with said message section supporting said frame portion to expose and display said photo;

closure means carried on said closure flap for releasably securing said closure flap to said back portion when said sheet is in said first mailer position;

said frame portion includes a segment having a pair of edge separation means for partially detaching said segment from said frame portion whereby said frame portion and said message portion support said photo when said frame portion is in said second frame position; and said attachment means includes residue adhesive on said closure flap after initial use to provide said mailer position.

* * * * *